US007119349B1

(12) United States Patent
Shimojo et al.

(10) Patent No.: US 7,119,349 B1
(45) Date of Patent: Oct. 10, 2006

(54) CONCRETE CASK AND METHOD FOR MANUFACTURING THEREOF

(75) Inventors: Jun Shimojo, Takasago (JP); Hiroaki Taniuchi, Takasago (JP); Yutaka Sugihara, Ichikawa (JP); Eiji Owaki, Yokohama (JP); Akihito Hata, Suginami-ku (JP); Katsuhiko Hirakawa, Sapporo (JP); Shigeyoshi Miyahara, Yokohama (JP)

(73) Assignees: Kabushiki Kaisha Kobe Seiko Sho, Hyogo (JP); Taisei Corporation, Tokyo (JP)

( * ) Notice: Subject to any disclaimer, the term of this patent is extended or adjusted under 35 U.S.C. 154(b) by 146 days.

(21) Appl. No.: 10/767,349

(22) Filed: Jan. 30, 2004

(30) Foreign Application Priority Data

Jan. 31, 2003 (JP) ..... 2003-024208

(51) Int. Cl.
*G21F 5/00* (2006.01)

(52) U.S. Cl. ..... 250/507.1; 250/506.1

(58) Field of Classification Search ..... None
See application file for complete search history.

(56) References Cited

U.S. PATENT DOCUMENTS 3,005,105 A * 10/1961 Lusk ..... 250/506.1
3,113,215 A * 12/1963 Allen ..... 250/506.1
3,886,368 A * 5/1975 Rollins et al. ..... 250/507.1
5,641,970 A * 6/1997 Taniuchi et al. ..... 250/506.1
5,740,546 A 4/1998 Hooper
5,887,042 A * 3/1999 Akamatsu et al. ..... 376/272
6,389,093 B1 5/2002 Gluschke et al.
2003/0102445 A1* 6/2003 Kamoshida et al. ..... 250/507.1

FOREIGN PATENT DOCUMENTS

JP 3166097 6/1994
JP 3342994 8/1995
JP 2001-141891 11/1999

* cited by examiner

*Primary Examiner*—Nikita Wells
*Assistant Examiner*—Anthony Quash
(74) *Attorney, Agent, or Firm*—Reed Smith LLP; Stanley P. Fisher, Esq.; Juan Carlos A. Marquez, Esq.

(57) ABSTRACT

It is an object of the present invention to obtain a containment concrete cask which has heat removal capacity maintained at the conventional level or beyond it and which prevents radiation from leaking to the outside. In a concrete cask, a shielding body composed of concrete and heat transfer fins made from metal are provided between an inner shell and an outer shell made from metal, and an accommodation portion for accommodating a radioactive substance is provided inside the inner shell. The accommodation portion has a containment structure to be insulated from the outside of the cask. In the heat transfer fins, the portions thereof at the outer shellside are provided in contact with the outer shell and the portions thereof at the inner shell side are cut so as to form a separation portion with respect to the inner shell.

19 Claims, 13 Drawing Sheets

FIRST EMBODIMENT

FIRST EMBODIMENT

SECOND EMBODIMENT

THIRD EMBODIMENT

FOURTH EMBODIMENT

FIFTH EMBODIMENT

SIXTH EMBODIMENT

SEVENTH EMBODIMENT

EIGHTH EMBODIMENT

FIFTH EMBODIMENT

COMPARATIVE REFERENCE EXAMPLE

THIRD EMBODIMENT

FOURTH EMBODIMENT

WITHOUT HEAT TRANSFER FINS

CONCRETE CASK AND METHOD FOR MANUFACTURING THEREOF

BACKGROUND OF THE INVENTION

1. Field of the Invention

The present invention relates to a concrete cask suitable for the transportation or long-term storage of radioactive material such as spent nuclear fuels.

2. Description of the Related Art

Concrete casks described in Japanese Patent Applications Laid-open No. 2001-141891 and Japanese Patent No. 3342994 are known as the conventional concrete casks. Japanese Patent Application Laid-open No. 2001-141891 describes a representative conventional concrete cask provided in the top part thereof with a gas outlet opening and in the lower part thereof with a gas inlet opening. In this structure, convection is generated in a gap between the concrete cask and a canister so as to introduce outside air through the inlet opening and release it through the outlet opening. As a result, heat is removed from the canister (sealed container containing the spent fuel) that is stored inside the concrete cask.

Japanese Patent No. 3342994 described a metal cask structure in which a neutron shielding material is provided between an outer shell and an inner shell. In order to enhance the heat transfer between the outer and inner shells, both ends of heat transfer fins made from a metal material with good thermal conduction, such as copper, are connected in their entirety to the inner shell and outer shell. The heat transfer fins are provided radially along the radial direction.

In the structure of Japanese Patent Application Laid-open No. 2001-141891, heat is removed by providing gas inlet and outlet openings and introducing outside air. In this case, corrosion-inducing substances such as sea salt particles contained in the outside air are unavoidably introduced into the concrete cask and adhere to the canister surface. As a result the canister surface is corroded and sometimes stress corrosion cracking can occur under the combined effect with the residual stresses present in the vicinity of welds in the canister. Such cracking means that the containment of canister is disrupted and radioactive material can be emitted to the outside. Furthermore, because the above-mentioned openings serving as the inlet and outlet were the portions that were not covered with a shielding body (portions that lack shielding), radiation streaming from those openings could not be avoided.

In the configuration described in Japanese Patent 3342994, the inner shell and outer shell were connected by both ends of the heat transfer fins in their entirety. Therefore, the problem was that no shielding body was present in the heat transfer fin portions and radiation penetrated through the heat transfer fins and streamed in the radial direction. Furthermore, because of the structure in which the heat transfer fins were in contact with the inner and outer shells, the neutron shielding material such as a concrete had to be placed in the spaces bounded by the inner and outer shells and heat transfer fins one by one, or structural blocks had to be assembled. In this case the manufacture was a time-consuming operation.

It is an object of the present invention to provide a concrete cask that is effective in suppressing the radiation streaming and is easy to manufacture.

SUMMARY OF THE INVENTION

Problems addressed by the present invention are described hereinabove.

In order to solve the above mentioned problems according to the present invention, a concrete cask in which a shielding body composed of concrete and heat transfer fins made from metal are provided between an inner shell and an outer shell made from metal and which comprises an accommodation portion formed inside the inner shell for accommodating a radioactive substance, a containment structure is employed to shield the accommodation portion from the outside of the cask, and in the heat transfer fins, the portions thereof at the inner shell-side are provided in contact with the inner shell and the portions thereof at the outer shell-side are cut so as to form a separation portion with respect to the outer shell, or the portions thereof at the outer shell-side are provided in contact with the outer shell and the portions thereof at the inner shell-side are cut so as to form a separation portion with respect to the inner shell.

These and other objects, features, and advantages of the present invention will become more apparent upon reading the following detailed description along with the accompanying drawings.

DESCRIPTION OF THE PREFERRED EMBODIMENTS

Figure 1:
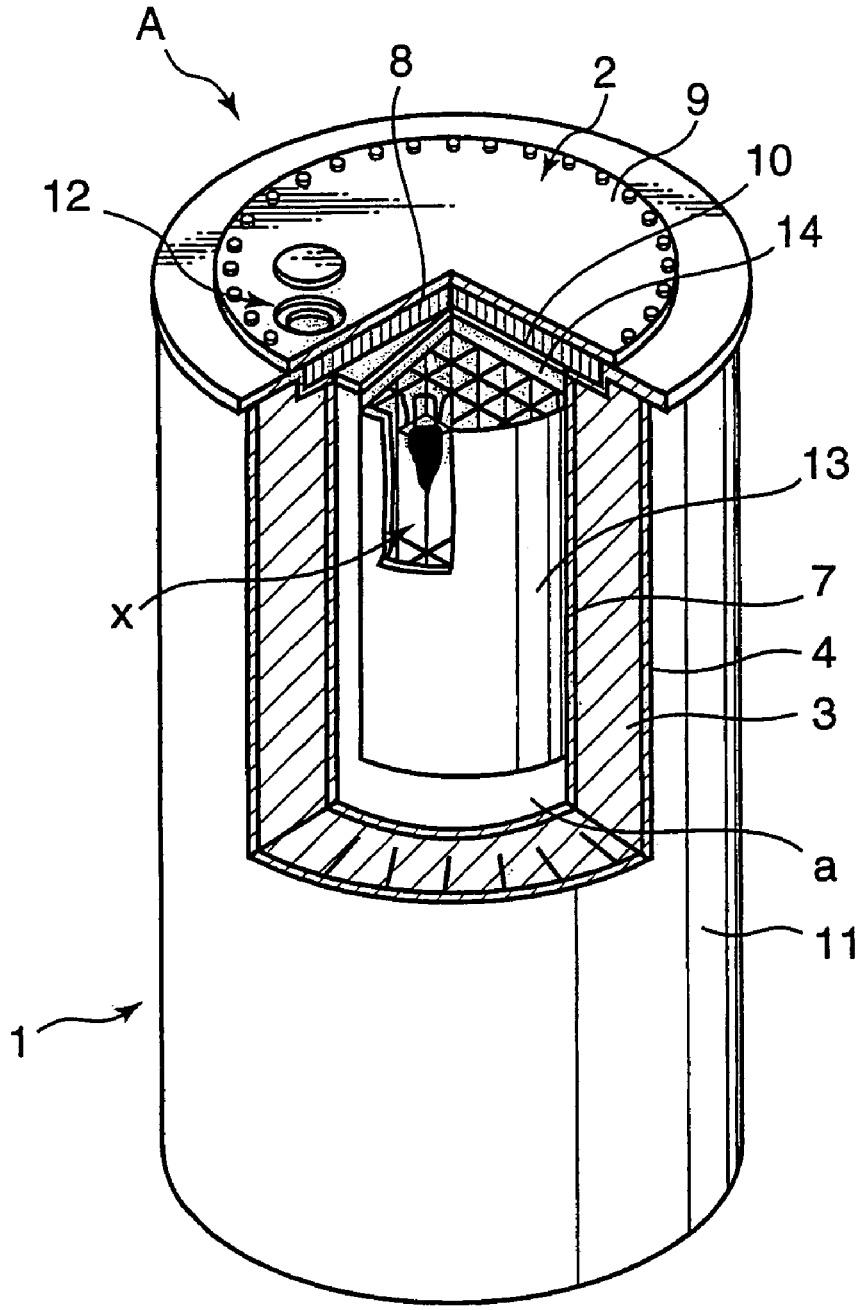
FIG. 1 is partially cut-out perspective view illustrating the storage state of the concrete cask of the first embodiment in accordance with the present invention.
Figure 2A:
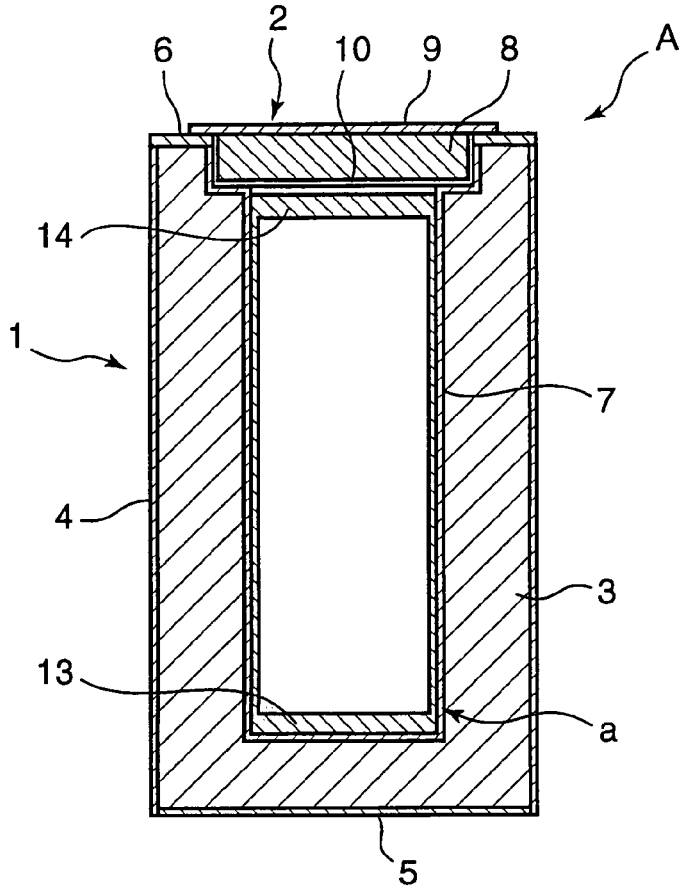
FIG. 2A is a longitudinal sectional view of the concrete cask of the first embodiment.
Figure 2B:
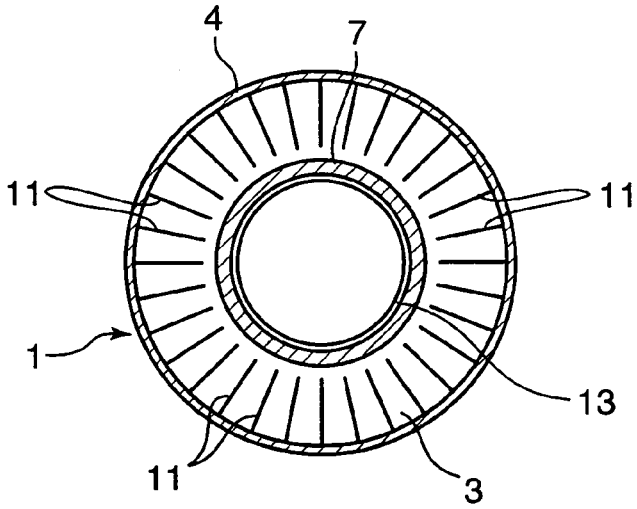
FIG. 2B is a lateral sectional view.

The basic structure of a concrete cask and the structure of heat transfer fins in the concrete cask will be described below. FIG. 1 is a perspective view with a partial cut-out illustrating the storage state of the concrete cask of the first embodiment of the present invention. FIG. 2A is a longitudinal sectional view of the concrete cask of the first embodiment, FIG. 2B is a lateral sectional view.

The concrete cask A of the first embodiment shown in FIG. 1 and FIG. 2 is composed of a tubular container body 1 open at both ends. A canister (a) is provided inside the concrete cask A.

The container body 1 has a structure in which a concrete container 3 is covered with an outer shell 4 made from carbon steel, a bottom cover 5 made from carbon steel, a thick flange made from carbon steel, and an inner shell 7 made from carbon steel. An accommodation portion for accommodating the canister (a) is constructed inside the inner shell 7 (inside the container body 1). A lid 2 has a structure in which a concrete lid member 8 is covered with a thick upper lid 9 made from carbon steel and a lower cover 10 made from carbon steel. Multiple heat transfer fins 11 made from copper, carbon steel, or aluminum alloy are embedded and installed in the container 3 so as to be connected to the inner wall of the outer shell 4, as shown in FIG. 1 or FIG. 2B.

The heat transfer fins are not required to be provided along the entire length in the axial direction of the container and may be provided only in the zones necessary for heat emission. For example, it is not particularly necessary to provide the heat transfer fins in the portion below the canister.

Disposing the lid 2 on the container body 1 seals the space (accommodation portion) inside the inner shell 7 and shields the space from the outside of the concrete cask A. A seal monitoring device 12 is installed in the lid 2 to check the sealing state (see FIG. 1).

The canister (a) is a sealed container composed of a container body 13 and a lid 14. The inside thereof is filled with a radioactive substance (x) such as spent nuclear fuel.

As shown in FIG. 2B, multiple heat transfer fins 11 are provided equidistantly between the inner shell 7 and outer shell 4 in the tangential direction for enhancing the dissipation of heat emitted from the radioactive substance (x) to the outside of the concrete cask A. Respective heat transfer fins 11 are formed to have a flat shape (I-like shape in a lateral sectional view) and are disposed radially along the radial direction of the container 3. The end portions of the respective heat transfer fins 11 at the side of the outer shell 4 are connected to the inner wall of the outer shell 4, whereas the end portions thereof at the side of the inner shell 7 are provided with separation portions with respect to the outer wall of the inner shell 7. Thus, the ends at the inner side of heat transfer fins 11 are cut out and the end portions are located at an appropriate distance from the inner shell 7.

As for the cut portions, the cutting is conducted along the entire axial direction of the container, and the heat transfer fins 11 and the inner shell 7 are completely separated.

In the structure of the first embodiment, even if the radiation penetrates through the heat transfer fins 11 in the radial direction, because a separation portion is present between the inner shell 7 and the heat transfer fins 11, the radiation has to pass through the concrete 3 of the separation portion. It means that even when the radiation leaks in the radial direction, it has to pass through the concrete 3 serving as a shielding body, and the structure of the concrete cask A with excellent radiation shielding capacity can be provided.

Another advantage of this structure is that the container 1 body can be manufactured easily. Thus, when the container 1 is manufactured, the inner and outer shells 7 and 4 are formed and then fresh concrete 3 is placed between the inner and outer shells 7 and 4. With respect to this issue, when the conventional configuration (configuration shown in FIG. 11), such as described in Japanese Patent No. 3342994, is manufactured, a fresh concrete 3 has to be placed in all the cells one by one (that is, in all the spaces separated by respective heat transfer fins 30 shown in FIG. 11). However, in the configuration of the present embodiment, the individual cells are linked together by the separation portion, and even when the fresh concrete 3 is poured in only one place, the fresh concrete can spread to all the cells. Therefore, the number of production process is reduced.

Furthermore, the fact that the heat transfer fins 11 and the inner shell 7 are completely separated means that the inner and outer shells 7 and 4 are not connected by the heat transfer fins 11. Therefore, a manufacturing process can be employed by which the inner shell 7 and the outer shell 4 are produced separately in advance and then assembled. As a result, in this sense, too, the structure of the first embodiment can be advantageous in terms of reducing the number of production process.

The above-described effects are also demonstrated in the second to eighth embodiments described hereinbelow. All those embodiments will be explained below. FIGS. 3 through 9 are the lateral sectional views of the second to eighth embodiments.

Figure 3:
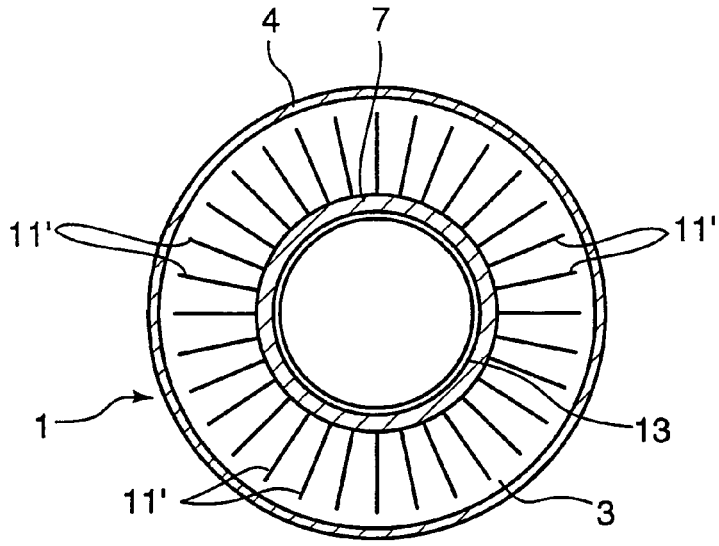
FIG. 3 is a lateral sectional view of the concrete cask of the second embodiment.

In the second embodiment illustrated by a lateral sectional view in FIG. 3, the end portions of the heat transfer fins 11 at the side of the inner shell 7 are connected to the outer wall of the inner shell 7, whereas the end portions at the side of the outer shell 4 are disposed via a separation portion with respect to the inner wall of the outer shell 4. Thus, the heat transfer fins 11' are disposed at a certain distance from the outer shell 4, that is the structure is inversed with respect to that of the first embodiment (FIG. 2B).

Figure 4:
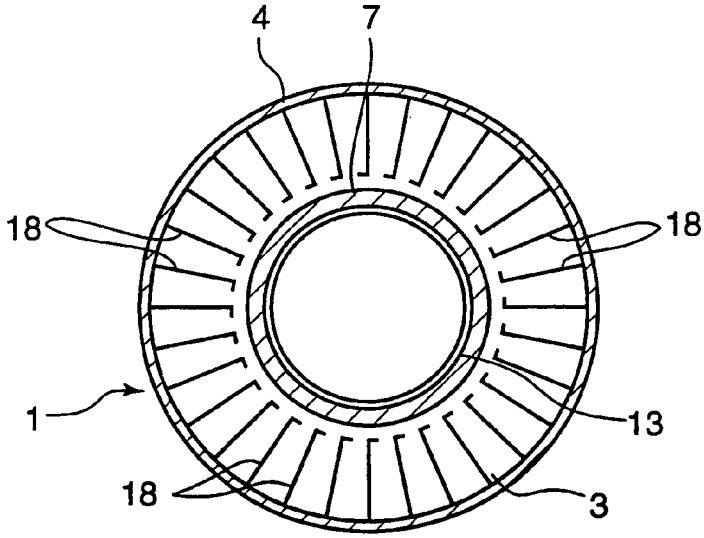
FIG. 4 is a lateral sectional view of the concrete cask of the third embodiment.

In the third embodiment illustrated by a lateral sectional view in FIG. 4, the end portions of the heat transfer fins 18 at the side of the outer shell 4 are connected to the inner wall of the outer shell 4, whereas the end portions at the side of the inner shell 7 (ends that form a separation portion with respect to the inner shell 7) are bent at an almost right angle along the appropriate width to obtain an L-like shape. As a result, the portions that were bent (bent portions) form opposite surfaces that face the outer wall of the inner surface 7 at an appropriate distance therefrom (separation portion).

Figure 5:
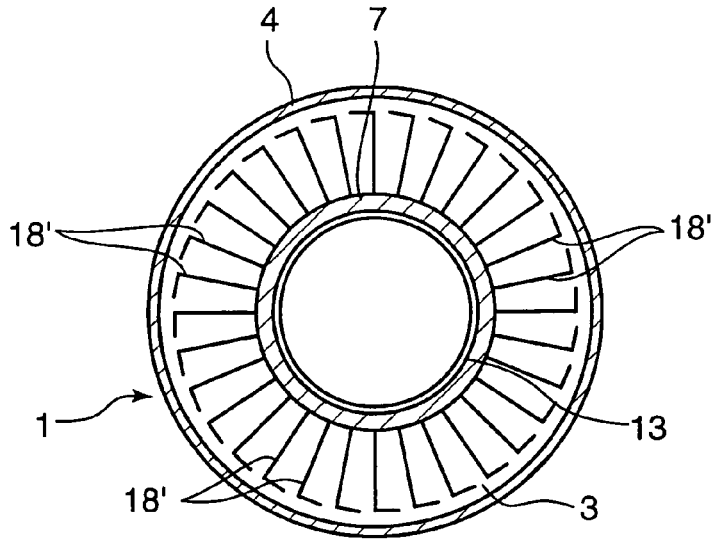
FIG. 5 is a lateral sectional view of the concrete cask of the fourth embodiment.

In the fourth embodiment illustrated by a lateral sectional view in FIG. 5, the end portions of the heat transfer fins 18' at the side of the inner shell 7 are connected to the outer wall of the inner shell 7, whereas the end portions at the side of the outer shell 4 (ends that form a separation portion with respect to the outer shell 4) are bent at an almost right angle along the appropriate width to obtain an L-like shape. As a result, the portions that were bent (bent portions) form opposite surfaces that face the inner wall of the outer shell 4 at an appropriate distance therefrom (separation portion).

In the above-described third and fourth embodiments, the heat transfer fins 18, 18' have such bent portions. Therefore, a large surface area of the surfaces (opposite surfaces) of the heat transfer fins 18, 18' that face the inner shell 7 or outer shell 4 can be ensured. As a result, heat transfer can be enhanced and a concrete cask A with excellent cooling capacity can be obtained.

Figure 6:
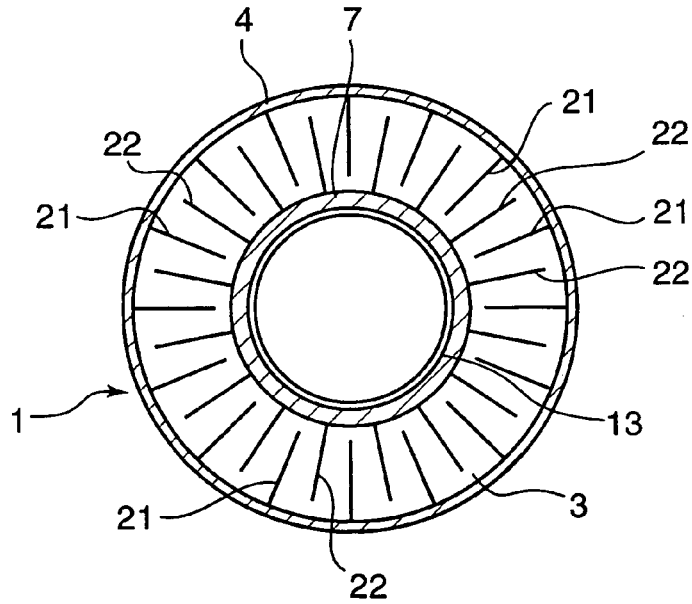
FIG. 6 is a lateral sectional view of the concrete cask of the fifth embodiment.

In the configuration of the fifth embodiment illustrated by a lateral sectional view in FIG. 6, first heat transfer fins 21 and second heat transfer fins 22 are disposed alternately and equidistantly in the tangential direction of the container 3.

The first heat transfer fins 21 are cut so that the end portions thereof at the side of the outer shell 4 are connected to the inner wall of the outer shell 4, whereas the end portions thereof at the side of the inner shell 7 form a separation portion with respect to the outer wall of the inner shell 7. The second heat transfer fins 22 are cut so that the end portions thereof at the side of the inner shell 7 are connected to the outer wall of the inner shell 7, whereas the end portions thereof at the side of the outer shell 4 form a separation portion with respect to the inner wall of the outer shell 4. Heat transfer fins of one type (21 or 22) are disposed so as to be inserted between the adjacent fins (22 or 21) of the other type. As a result, the first heat transfer fins 21 and second heat transfer fins 22 have overlap portions in the radial direction of the container 3.

In the structure of the fifth embodiment, the first heat transfer fins 21 and second heat transfer fins 22 have overlapping portions. Therefore, the advantage of this structure is that heat transfer between the heat transfer fins 21 and 22 is enhanced and excellent cooling effect is attained. Another merit of this structure is that because the heat transfer fins 21, 22 are formed to have a flat shape without bent portions, as in the first and second embodiments (the so-called I-like shape), bending of the heat transfer fins 21, 22 is not required and the number of processing operations can be reduced.

Figure 7:
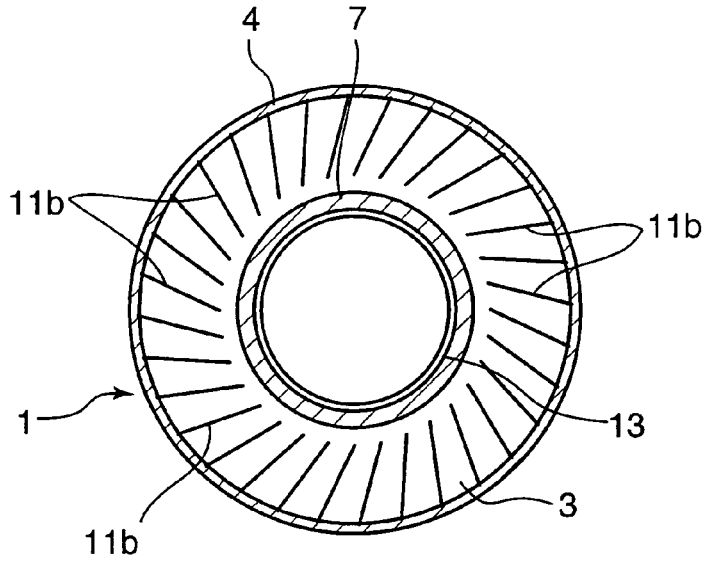
FIG. 7 is a lateral sectional view of the concrete cask of the sixth embodiment.

In the sixth embodiment illustrated by the lateral sectional view in FIG. 7, the heat transfer fins 11 of the first embodiment are inclined at a prescribed angle from the radial direction of the container 3 (reference symbol 11*b*). A structure can be also considered in which the heat transfer fins 11' of the second embodiment are similarly inclined at a prescribed angle from the radial direction (this structure is not shown in the figures).

Figure 8:
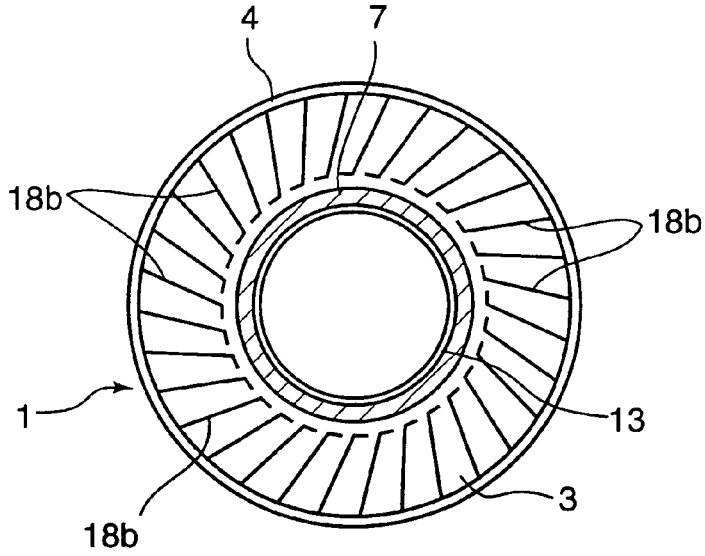
FIG. 8 is a lateral sectional view of the concrete cask of the seventh embodiment.

In the seventh embodiment illustrated by the lateral sectional view in FIG. 8, the portions of the heat transfer fins 18 of the third embodiment, which follow the radial direction of the container 3 (portions other than the aforesaid bend portions), are inclined at a prescribed angle from the radial direction of the container 3 (reference symbol 18*b*). A structure can be also considered in which the heat transfer fins 18' of the fourth embodiment are similarly inclined at a prescribed angle from the radial direction (this structure is not shown in the figures).

Figure 9:
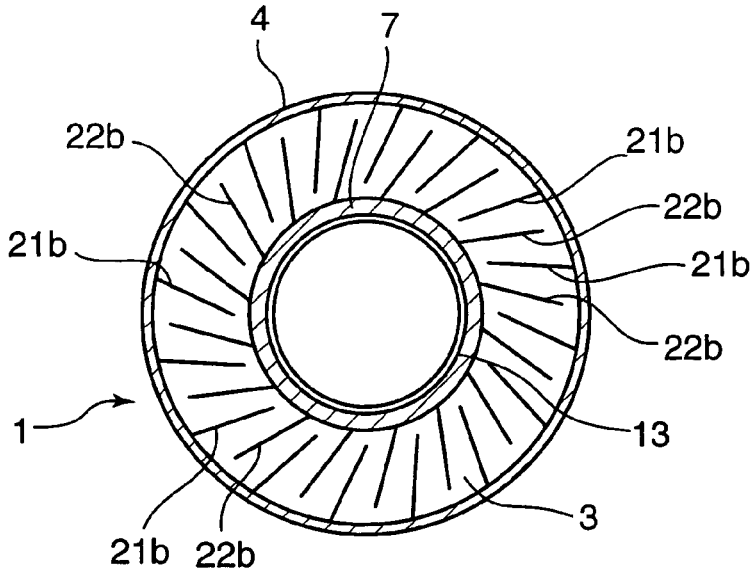
FIG. 9 is a lateral sectional view of the concrete cask of the eighth embodiment.

In the eighth embodiment illustrated by the lateral sectional view in FIG. 9, the first heat transfer fins 21 and second heat transfer fins 22 of the fifth embodiment are similarly inclined at a prescribed angle from the radial direction (reference symbols 21*b*, 22*b*).

In those sixth to eighth embodiments, the heat transfer fins (11*b*, 18*b*, 21*b*, 22*b*) are disposed in an inclined state so as to decline from the radiation direction (radial direction of the container 3). The effect of such an arrangement is that streaming of radiation in the radial direction can be suppressed even more reliably.

Figure 10:
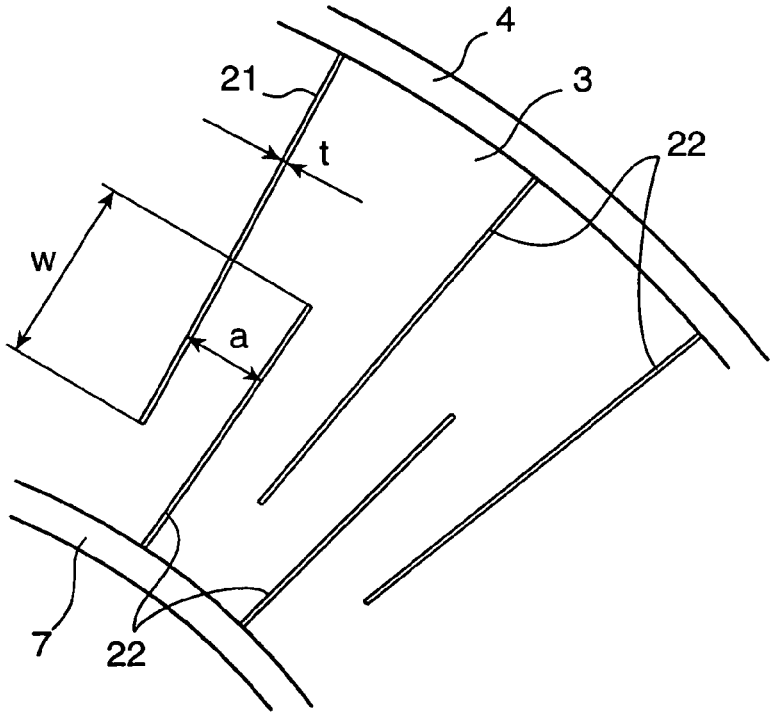
FIG. 10 is a partly enlarged lateral sectional view of the container of the fifth embodiment.
Figure 11:
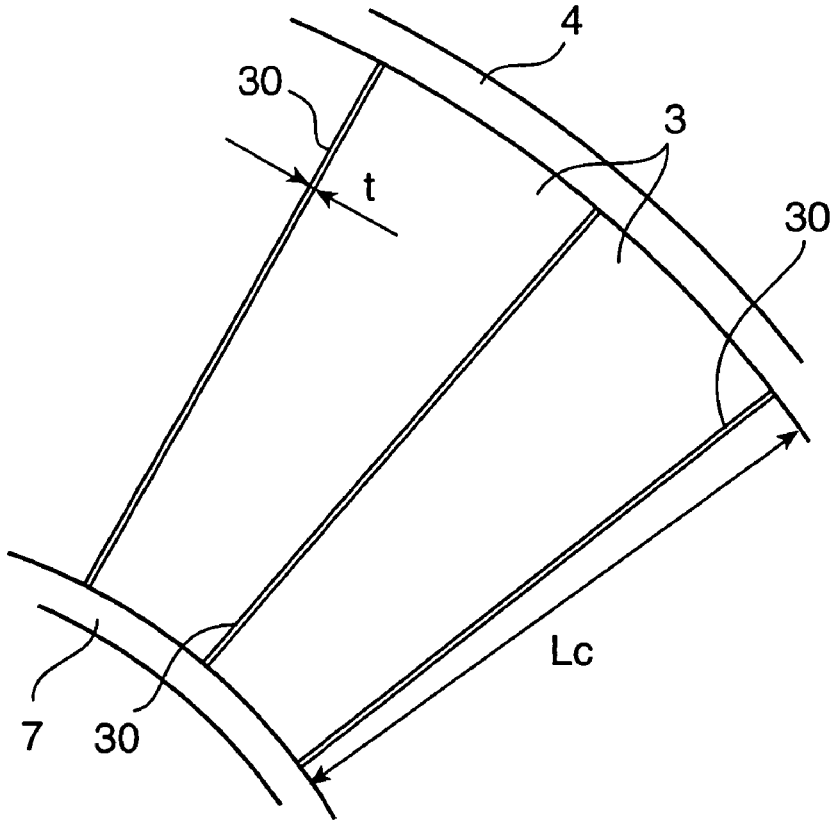
FIG. 11 is a partly enlarged lateral sectional view of the container of the structure according to the comparative reference example (related technology)

Further, the heat transfer capacity (heat removal capability) of the concrete cask will be explained hereinbelow with reference to the case in which heat transfer fins 21, 22 are installed alternately in a zigzag manner, as in the fifth embodiment. FIG. 10 is a partially expanded lateral sectional view of the container of the fifth embodiment, and FIG. 11 is a partially expanded lateral sectional view of the container with the configuration of the comparative reference example (conventional technology).

It is well known that the equation relating to heat conduction can be represented by the following equation [A]:

$$Q=\lambda\times S\times\Delta T/L \qquad [A]$$

where:

λ: thermal conductivity of a thermally conductive substance (W/m·K);

S: surface area of the heat transfer path of the thermally conductive substance (heat transfer surface area perpendicular to the direction of heat flux) ($m^2$);

ΔT: difference in temperature between the inner shell and outer shell (K);

L: length of the heat transfer path (m).

In the above-described fifth embodiment of the present invention in which a discontinuous portion is present in the heat transfer fins 21, 22, the following designations can be used:

λc: thermal conductivity of the concrete shielding body 3 (W/m·K);

Sc: surface area of the heat transfer path of the concrete shielding body 3 in the region where the heat transfer fins 21, 22 overlap (referred to hereinbelow as "overlap portion") ($m^2$);

Tif: temperature of the heat transfer fins 22 at the side of the inner shell 7 in the overlap portion (K);

Tof: temperature of the heat transfer fins 22 at the side of the outer shell 4 in the overlap portion (K);

(a) distance between the heat transfer fins 21, 22 in the overlap portion (m), and λ=λc, S=Sc, ΔT=Tif−Tof, L=a can be substituted into the aforesaid equation [A].

As a result, the heat transfer quantity QI between the heat transfer fins of two types can be obtained in the following form:

$$QI=\lambda c\times Sc(Tif-Tof)/a \qquad [C]$$

Further, as a comparative reference example corresponding to the above-described configuration, a structure will be considered in which the inner and outer shells 7, 4 are directly connected by heat transfer fins 30 (structure shown in FIG. 11 disclosed in Japanese Patent Application Laid-open No. 2001-3342994). In this case, the following designations can be used:

λf: thermal conductivity of the heat transfer fins 30 (W/m·K);

Sf: surface area of the heat transfer fins 30 ($m^2$);

Tis: temperature of the inner shell 7 (K);

Tos: temperature of the outer shell 4 (K);

Lc: thickness of the concrete shielding body 3 (m), and $\lambda=\lambda f$, $S=Sf$, $\Delta T=Tis-Tos$, $L=Lc$ can be substitute into the aforesaid equation [A]. The heat transfer quantity QP between the inner and outer shells in this structure can be obtained in the following form:

$$QP=\lambda f\times Sf(Tis-Tos)/Lc \quad [B]$$

Here, the heat transfer capacity (QI) of the concrete area in the structure of the fifth embodiment is inevitably somewhat inferior to the heat transfer capacity (QP) in the structure in which the inner and outer shells 7, 4 were directly connected by the heat transfer fins 30. However, if the number of the heat transfer fins 21, 22 is increased to compensate for this deficiency, then the heat transfer capacity (heat removal capability) necessary for the concrete cask A can be ensured.

However, because the arrangement space of heat transfer fins 21, 22 is also limited, limitations are also placed on the possibility of such compensation. Therefore, the heat transfer quantity QI of the concrete area of this embodiment can be assumed to be limited to ½ of the heat transfer quantity QP obtained in the case in which the inner and outer shells 7, 4 are directly connected to the heat transfer fins 30. Accordingly, if the condition $$QP\times 0.5\leqq QI \quad [D]$$

is satisfied, it will apparently be possible to obtain a concrete cask 4 in which the required heat transfer capacity can be actually attained, while effectively avoiding the radiation streaming as described hereinabove.

Based on those results, the following formula $$(\lambda f\times Sf\times(Tis-Tos)/Lc)\times 0.5\leqq\lambda c\times Sc\times(Tif-Tof)/a \quad [E]$$

can be obtained by substituting formulas [B] and [C] into formula [D].

Here, when the heat transfer fins 30 are installed uniformly in the axial direction of the container 3, as in the comparative reference example shown in FIG. 11, the following equation is valid:

$$Sf=t\times M \quad [F]$$

Here, M stands for a length of the heat transfer fins 30 in the axial direction of the container 3.

Further, in the fifth embodiment, when the heat transfer fins 21, 22 uniformly overlap in the axial direction of the container 3 (the case in which the lateral section of FIG. 10 appears uniform regardless of the position in the axial direction in which the container was cut), the following equation is valid:

$$Sc=w\times M \quad [G]$$

Here, w stands for a length of the overlap region of the first and second heat transfer fins 21, 22.

Furthermore, when the heat conductivity of the heat transfer fins (21, 22, 30) is sufficiently large by comparison with that of the concrete shielding body 3, the following approximation is possible:

$$Tis-Tos\approx Tif-Tof \quad [H]$$

Therefore, substituting formulas [F]–[H] makes it possible to simplify the formula [E] as the formula [I] presented below:

$$(\lambda f\times t)/Lc\times 0.5\leqq(\lambda c\times w)/a \quad [I]$$

The formula of claim 3 can be obtained from the formula [I].

The aforesaid formula [I] demonstrates that the heat transfer capacity (QI) in the concrete heat transfer region of the overlap portion in the fifth embodiment may be not less than the heat transfer capacity (QP) of the configuration of the comparative reference example, that is, the configuration in which the inner and outer shells 7, 4 were directly connected by the heat transfer fins 30, multiplied by 0.5 ($QP\times 0.5\leqq QI$).

However, from the standpoint of the production cost and the number of operations, it is better to avoid the increase in the number of installed heat transfer fins 21, 22 even in the fifth embodiment. Furthermore, it is even more preferred that the heat transfer capacity QI be equal to or more than the heat transfer capacity QP obtained when the inner and outer shells 7, 4 are connected by the heat transfer fins 30 ($QP\leqq QI$). If the above-described formulas [F]–[H] are substituted into this formula, then formula [J] given below can be derived.

$$(\lambda f\times t)/Lc\leqq(\lambda c\times w)/a \quad [J]$$

By equating the lefthand side and the right-hand side of the above mathematical expression [J], the relation of "w" (overlapping amount of heat transfer fins in radial direction) and "a" (separation amount at the overlapping portion) can be obtained in the desired case where the heat transfer capacity Qi and the heat transfer capacity Qp become equal to each other.

Hereinafter, example values as practical example to be substituted into the mathematical expression are:

$\lambda f=392W/(m\cdot K)$ (In case of Cupper Fin)

$\lambda c=1.37W/(m\cdot K)$ (In case of Concrete Material)

Lc=0.855m t=0.006m

Plug all the above values into the mathematical expression, then we get the following relation between "w" and "a".

$$w=2.0a \quad (J\text{-}1)$$

From the obtained relation in the above [J-1], it can be observed that the overlapping amount "w" needs to be set twice as much as the separation distance "a" in order to have a heat transfer capacity QI substantially the same as the heat transfer capacity Qp. Accordingly, from the following list, it is desirable to pick one or several value combination such that the flow of raw concrete during the filling of the space between the inner shell and the outer shell with concrete is not blocked.

| w (mm) | a (mm) |
|---|---|
| 20 | 10 |
| 40 | 20 |
| 60 | 30 |
| 80 | 40 |
| 100 | 50 |
| 120 | 60 |
| 141 | 70 |
| 161 | 80 |
| 181 | 90 |
| 201 | 100 |

Note that the above values such as Lc and t are merely for the examples and the suitable values are to be determined for an individual situation.

Figure 12:
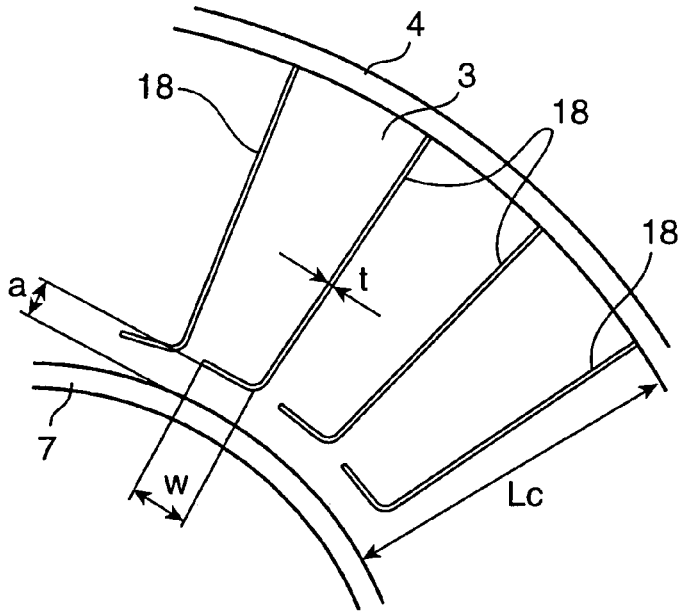
FIG. 12 is a partly enlarged lateral sectional view of the container of the third embodiment.

The heat transfer capacity (heat removal capacity) of the concrete cask A obtained when the L-shaped heat transfer fins 18 were mounted as in the third embodiment will be described below. FIG. 12 is a partially expanded lateral sectional view of the container of the third embodiment.

Similarly to the approach followed with respect to formula [D] above, the heat transfer capacity (QI1) obtained when the heat transfer fins 18 are disposed on the side of the outer shell 4, as in the third embodiment, because of the formula QP×0.5≦QI1, the following condition should be satisfied:

$$(\lambda f \times Sf(Tis-Tos)/Lc \times 0.5 \leqq \lambda c \times Sc \times (Tis-Tof)/a \quad [K]$$

Here,

Sc: surface area of the heat transfer path of the concrete in the region between the bent portion at the distal end of the heat transfer fin 18 and the inner shell 7 ($m^2$);

Tof: temperature of the region (the aforesaid bent portion) of the heat transfer fin 18 that faces the inner shell 7 (K);

a: distance between the region (the aforesaid bent portion) of the heat transfer fin 18 that faces the inner shell 7 and the inner shell 7 (m). The definitions of other parameters are absolutely identical to those of the parameters in the formulas of the above-described fifth embodiment and comparative reference example.

When the thermal conductivity of the heat transfer fins (18, 30) is sufficiently larger than that of the concrete shielding body, the following formula is valid:

$$Tis-Tos \approx Tis-Tof \quad [L]$$

Furthermore, when the heat transfer fins 18 in the third embodiment are disposed uniformly in the axial direction, the equation $$Sc=w \times M \quad [M]$$

is valid. Here, w stands for a length of the bent portion (portion facing the outer wall of the inner shell 7) of the heat transfer fin 18. Thus, w means the widthwise length of the opposite surface.

Therefore, the aforesaid formula [K] can be simplified as follows:

$$((\lambda f \times t)/Lc) \times 0.5 \leqq (\lambda c \times w)/a \quad [N]$$

The formula of claim 5 can be obtained from this formula [N].

Similarly to the approach followed with respect to formula [J] above, based on the formula QP≦QI1, it is preferred that the following formula be satisfied, which will allow the number of heat transfer fins 18 to be decreased:

$$(\lambda f \times t)/Lc \leqq (\lambda c \times w)/a \quad [O]$$

Figure 13:
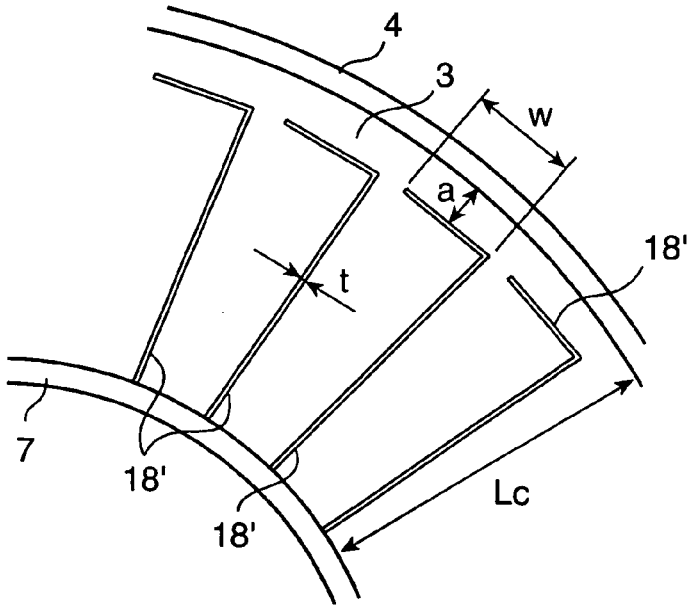
FIG. 13 is a partly enlarged lateral sectional view of the container of the fourth embodiment.

The heat transfer capacity (heat removal capacity) of the concrete cask obtained when the L-shaped heat transfer fins 18' were mounted on the side of the inner shell 7, as in the fourth embodiment, will be described below. FIG. 13 is a partially expanded lateral sectional view of the container of the fourth embodiment.

Similarly to the approach followed with respect to formula [D] above, the heat transfer capacity (QI2) obtained when the heat transfer fins 18 are disposed on the side of the inner shell 7, as in the fourth embodiment (FIG. 13), because of the formula QP×0.5≦QI2, the following condition should be satisfied:

$$(\lambda f \times Sf(Tis-Tos)/Lc \times 0.5 \leqq \lambda c \times Sc \times (Tif-Tos)/a \quad [P]$$

Here,

Sc: surface area of the heat transfer path of the concrete in the region between the bent portion at the distal end of the heat transfer fin 18' and the outer shell 4 ($m^2$);

Tif: temperature of the region (the aforesaid bent portion) of the heat transfer fin 18' that faces the outer shell 4 (K);

a: distance between the region (the aforesaid bent portion) of the heat transfer fin 18' that faces the outer shell 4 and the outer shell 4 (m). The definitions of other parameters are absolutely identical to those of the parameters in the formulas of the above-described fifth embodiment and comparative reference example.

When the thermal conductivity of the heat transfer fins (18', 30) is sufficiently larger than that of the concrete shielding body, the following formula is valid:

$$Tis-Tos \approx Tif-Tos \quad [Q]$$

Furthermore, when the heat transfer fins 18' in the fourth embodiment are disposed uniformly in the axial direction, the equation $$Sc=w \times M \quad [R]$$

is valid. Here, w stands for a length of the bent portion (portion facing the inner wall of the outer shell 4) of the heat transfer fin 18'. Thus, w means the widthwise length of the opposite surface.

Therefore, the aforesaid formula [K] can be simplified as follows:

$$((\lambda f \times t)/Lc) \times 0.5 \leqq (\lambda c \times w)/a \quad [S]$$

The formula [S] is identical to the formula [N] and can be also used to obtain the formula of claim 5.

Similarly to the approach followed with respect to formula [J] above, based on the formula QP≦QI2, it is preferred that the following formula be satisfied, which will allow the number of heat transfer fins 18' to be decreased:

$$(\lambda f \times t)/Lc \leqq (\lambda c \times w)/a \quad [T]$$

The heat transfer capacity (heat removal capacity) of the concrete cask having no heat transfer fins will be explained below.

Figure 14:
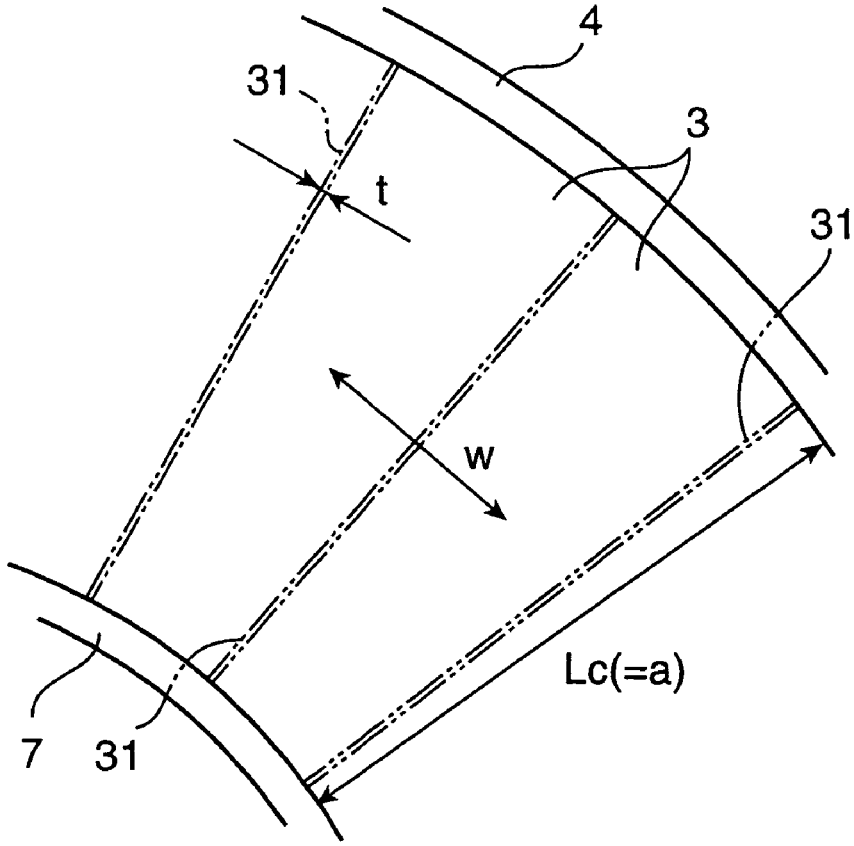
FIG. 14 is a partly enlarged lateral sectional view of the container in the structure without heat transfer fins.

FIG. 14 is a partially expanded lateral sectional view of the container with a configuration containing no heat transfer fins.

An assumption will be made that in the structure shown in FIG. 14 heat transfer fins 31 are present in the radial direction between the inner and outer shells 7, 4, and the width of the region of the concrete shielding body 3 of one-pitch spacing sandwiching the heat transfer fin 31 will be denoted by w.

Further, the following designations will be used:

Lc: thickness of the concrete shielding body 3 (m);

a: length of the virtual heat transfer fin 31 in the radial direction (m);

λc: thermal conductivity of the concrete shielding body 3 (W/m·K);

λf: thermal conductivity of the virtual heat transfer fin 31 (W/m·K);

t: thickness of the virtual heat transfer fin 31 (m);

w: width of the region of the concrete shielding body 3 of one-pitch spacing sandwiching the heat transfer fin 31 (m).

In this case, as a singular example of the above-described formulas [N] and [S], the following equation is valid:

$$Lc=a \quad [U]$$

Therefore, the following formula is valid:

$$\lambda f \times t \leqq \lambda c \times w \quad [V]$$

This formula [V] means that if a concrete is used that has thermal conductivity satisfying the relation described by the aforesaid formulas, then a concrete cask with a sufficient heat removal capacity can be designed (even if the heat transfer fins that have been considered indispensable in the past are absent).

The thermal conductivity of a concrete shielding material enabling the heat removal design without heat transfer fins will be found hereinbelow by assuming a specific design structure of the concrete cask. The size, caloric value, and temperature difference between the inner and outer shells in the cask for which the heat removal capacity is to be established are substituted into the aforesaid formula [A] ($Q=\lambda \times s \times \Delta T/L$). Those values were obtained by preliminary testing. More specifically, those values are:

Internal caloric value: Q=14 kW.

Difference in temperature between the inner shell 7 and the outer shell 4: $\Delta T=50K$.

Thickness of the shielding body: L=Lc=0.35 m.

Inner diameter of the inner shell 7: D=1.6 m.

Length of the heat-generating region in the axial direction: M=3.7 m.

As for the heat transfer path surface area S, the virtual cylinder obtained by dividing the shielding body 3 into two equal sections in the radial direction is considered and the surface area of the circumference thereof is considered as a mean heat transfer path surface area. Furthermore, to simplify the calculations, the thickness of the inner and outer shells 7, 4 is ignored, and the diameter of the virtual cylinder is considered to be D+Lc. Therefore, the following equation is valid $$S=\pi(D+Lc)\times M=\pi\times(1.6+0.35)\times 3.7=23\ (m^2).$$

If those numerical values are substituted into the equation (A), then $\lambda=14000/23/50\times 0.35=4.3$ (W/m·K). Thus, this calculation example shows that if a concrete shielding body with a thermal conductivity of at least about 4 W/m·k is prepared, then the heat removal capacity identical to that of the concrete cask of the conventional type having heat transfer fins can be demonstrated even without the heat transfer fins.

A concrete material with the above-described excellent thermal conduction characteristic can be obtained by admixing copper or copper alloys having excellent thermal conduction characteristic in the form of a powder, fibers, lumps, and the like. Furthermore, from the standpoint of increasing the density (effective for gamma radiation shielding), in addition to improving the thermal conduction characteristic of this concrete material, the addition of a metal material or compounds comprising iron, copper, tungsten, and the like is also effective.

Using copper or copper alloys for the above-described heat transfer fins (11, 11', 18, 18', 21, 22) is most preferred because of their excellent thermal conduction capacity and high corrosion resistance in the alkali environment of concrete. However, when the caloric value of the radioactive substance, x, introduced into the canister (a) is comparatively small, it is not necessary to use copper or copper alloys, and ferrous materials may be used. Examples of materials with an excellent heat transfer capacity also include aluminum and aluminum alloys, but because they are dissolved in alkali environment, they can hardly be used by mixing with concrete. However, if the surface thereof is plated or subjected to anodization, they still can be used as heat transfer fins for the concrete cask.

Because the concrete cask A with the present structure does not allow for the ventilation of the canister (a) (the structure such as disclosed in Japanese Patent Application laid-open No. 2001-141891), it is highly probable that the concrete material will be exposed to a high temperature of 100° C. or higher. In such an atmosphere, the free water contained in the concrete material will be released. As a result, the content ratio of hydrogen (effective for neutron shielding) can be decreased and the neutron shielding capacity can be degraded. To prevent those effects, the necessary hydrogen content in the concrete material used for this concrete cask A can be maintained by admixing hydroxides retaining water (hydrogen) in the form of crystals, rather than retaining hydrogen in form of free water. In this case, even if the concrete temperature exceeds 100° C., the content of hydrogen necessary for neutron shielding will be present and the neutron shielding capacity of the concrete will be maintained as long as the decomposition temperature (temperature at which the dissociation pressure becomes 1 atm) and melting temperature of the hydroxides are not reached. It is preferred that the hydroxides be contained at a ratio of 15 mass % or more, based on the concrete material.

Examples of hydroxides with a melting point and decomposition temperature higher than 100° C., that is, hydroxides in which water is not decomposed at a temperature of 100° C., include hydroxides of alkaline earth metals such as Ca, Sr, Ba, Ra and hydroxides of metals analogous thereto, e.g. Mg. Such hydroxides hold water (hydrogen) as water of crystallization when mixed with the cured product and have excellent neutron shielding capacity. For example, because the decomposition temperature of calcium hydroxide is 580° C. and the melting point of barium hydroxide is 325° C. and the decomposition temperature thereof is 998° C., those compounds retain water (hydrogen) up to a high-temperature range. Examples of other hydroxides that can be mixed with the composition or cured product include lithium hydroxide, sodium hydroxide, potassium hydroxide, lanthanum hydroxide, chromium hydroxide, manganese hydroxide, iron hydroxide, cobalt hydroxide, nickel hydroxide, copper hydroxide, zinc hydroxide, aluminum hydroxide, lead hydroxide, gold hydroxide, platinum hydroxide, and ammonium hydroxide. Furthermore, it is preferred that the hydroxide be insoluble or poorly soluble in water. Adding such hydroxides makes it possible to introduce reliably the hydroxides that do not release water by decomposing at a temperature of more than 100° C. in the cured product after hydration reaction with cement. The hydroxides for mixing with the concrete composition have a dissolution quantity in 100 g of pure water at 20° C. of 15 g or less, more preferably of 5 g or less, most preferably 1 g or less. In terms of solubility, too, the above-mentioned hydroxides of alkaline earth metal or Mg which is a metal analogous thereto are preferred. For example, the aforesaid dissolution quantity of hydroxides of calcium, strontium and magnesium is 1 g or less, and the dissolution quantity of barium hydroxide is 5 g or less. Among those hydroxides, the hydroxides of calcium and magnesium are especially effective for increasing the neutron shielding capacity because the ratio of hydrogen contained in these hydroxides is high due to a low atomic weight of Ca and Mg. Furthermore, because calcium contained in calcium hydroxide is the main component of Portland cement and because calcium hydroxide is a substance formed by a hydration reaction in usual cements, the calcium hydroxide is most preferred among the above-mentioned hydroxides.

As described hereinabove, hydroxides are introduced into the present concrete material, thereby ensuring the necessary content of hydrogen. However, because hydroxides are sometimes decomposed by reacting with carbon dioxide present in the atmosphere and release water, they have to be shielded from the atmosphere.

For example, in the case of calcium hydroxide, if it reacts with carbon dioxide present in the atmosphere, it eventually becomes calcium carbonate and water (hydrogen) can be released from the crystals, causing long-term degradation of neutron shielding capacity. This reaction is represented by the following chemical formula:

$$Ca(OH)_2+CO_2 \rightarrow CaCO_3+H_2O$$

To prevent this effect, in the present embodiment, the concrete material is provided in a space shielded by the inner shell 7, outer shell 4, flanges, and a bottom plate composed from a carbon steel, stainless steel and the like, as a concrete cask structure.

The term "containment" as mentioned hereinabove means that outside air comprising carbon dioxide has no contact with the concrete cured body (the aforesaid concrete shielding body 3), and the "containment" in the aforesaid sense is not lost even if a safety relief valve is provided, for example in the outer shell 4, this valve serving to release gases generated during use of the concrete cask A to the outside.

Moreover, the "containment" in the aforesaid sense may be substantially attained with a structure in which contact of the concrete cured body with carbon dioxide is prevented by adsorbing carbon dioxide with an adsorbent or the like.

Degassing of concrete during the manufacture of the concrete cask A will be explained below.

Figure 15:
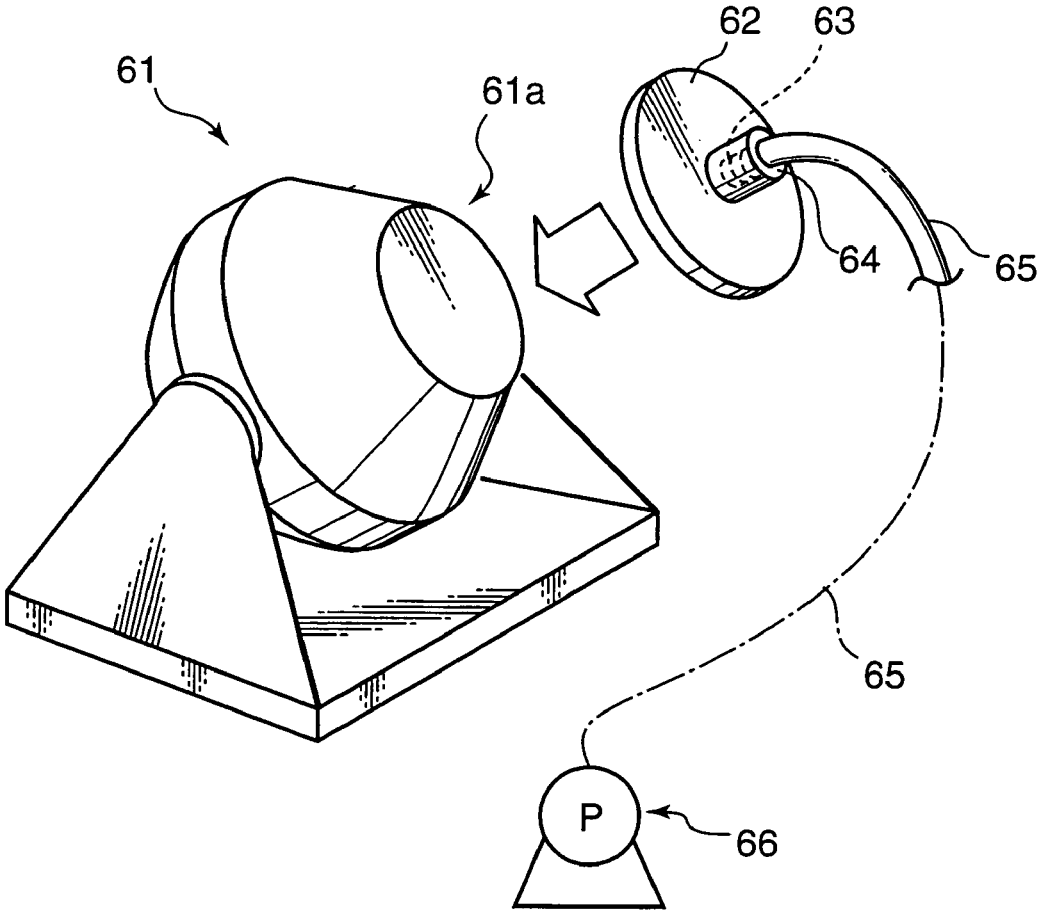
FIG. 15 illustrates a structural example of vacuum degassing during concrete mixing.
Figure 16:
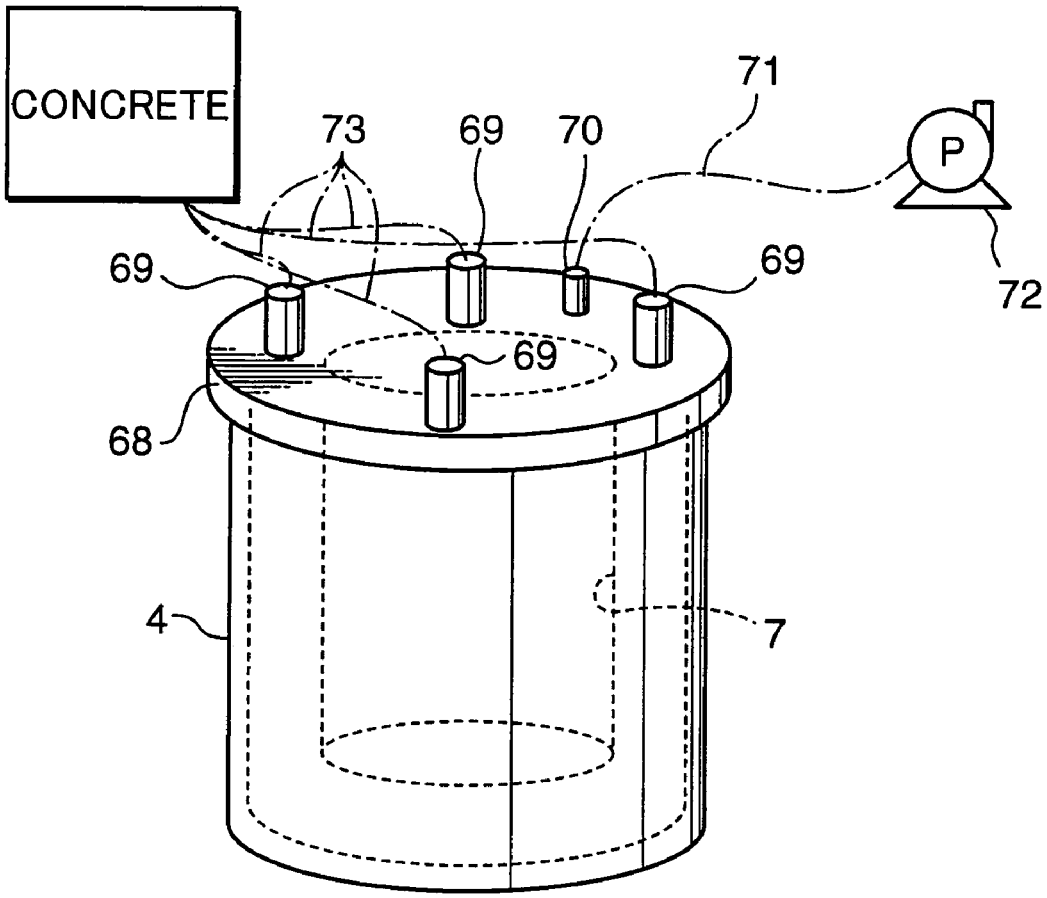
FIG. 16 illustrates a structural example of vacuum degassing during concrete placing.

Thus, there is a high probability that the air will penetrate into the concrete and pores will be formed therein when the concrete is mixed and placed. When the container 3 is composed of such a concrete, the pores present therein become the loss areas of the shielding body, which is undesirable from the standpoint of preventing the streaming of radiation. Therefore, a method for vacuum degassing during mixing or placing may be used. FIG. 15 illustrates an example of the configuration for vacuum degassing during concrete mixing, and FIG. 16 illustrates an example of the configuration for vacuum degassing during concrete placing.

Vacuum degassing during mixing can be conducted by employing a containment (sealed) structure of the mixing chamber of a mixing machine such as a pot mixer, a screw mixer, or a puddle mixer, and disposing a vacuum pump therein.

An example of the configuration for vacuum degassing during concrete mixing is shown in FIG. 15. In FIG. 15, the reference numeral 61 stands for a pot-type concrete mixer with a mixing chamber constructed inside the pot. The pot is equipped with a disk-like vacuum flange 62 detachably provided in the opening 61*a* of the pot. The vacuum flange 62 has an appropriate containment structure and can airtightly cover the opening 61*a*. As a result, the inside of the pot is sealed. An air suction opening (not shown in the figures) is formed on one side surface of the vacuum flange 62, and when the vacuum flange 62 is mounted on the concrete mixer 61, this air suction opening is connected to the space inside the pot.

A boss portion is provided in a protruding condition in the center of the surface on the other side of the vacuum flange 62, and a linking hole 63 is formed in the boss portion. The linking hole 63 is connected to the aforesaid air suction opening via an appropriate path formed in the space inside the vacuum flange 62. One end of the flexible hose 65 is attached to the linking hole 63. In order to prevent the flexible hose from twisting, a rotary joint 64 is introduced into a place of connection to the linking hole 63. The other end of the flexible hose 65 is connected to the suction side of the vacuum pump 66.

In the above-described structure, air bubbles are introduced into the concrete by mixing inside the pot, but the air bubbles can be sucked out and removed via the flexible hose 65 and the concrete can be degassed by degassing the inside of the mixing chamber by driving the vacuum pump 66 in parallel with the mixing operation.

FIG. 16 illustrates a structure for vacuum degassing during concrete placing. In the structure shown in FIG. 16, a sealable lid 68 is disposed above the inner and outer shells 7, 4. In the lid, concrete placing holes 69 are provided in several zones and a suction opening 70 is formed. The suction opening 70 is connected via an appropriate hose 71 to a vacuum pump 72. A pipe denoted by the reference numeral 73 serves for feeding the concrete.

When concrete is placed in this structure, fresh concrete is poured from the placing holes 69 into the space between the inner and outer shells 7, 4, and the vacuum pump 72 is driven to degas the space between the inner and outer shells 7, 4. As a result, the concrete is degassed.

In the structure of the embodiments of the present invention, because the inner and outer shells 7, 4 are not entirely partitioned by the heat transfer fins (11, etc.), the fresh concrete can flow from one cell to another. As a result, the number of zones for disposing the concrete placing holes 69 can be reduced, as shown in FIG. 16.

Figure 18A:
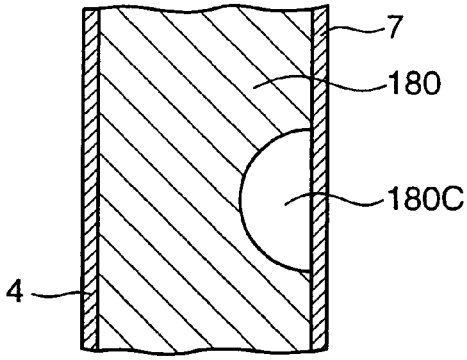
FIG. 18A is a longitudinal sectional view showing a heat transfer fin formed with a cutout potion on its radial end thereof.
Figure 18B:
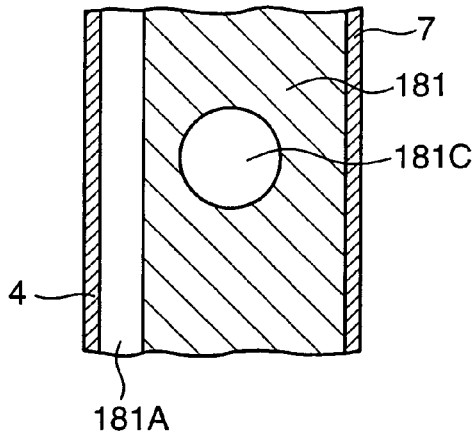
FIG. 18B is a longitudinal sectional view showing a heat transfer fin formed with an opening.
Figure 18C:
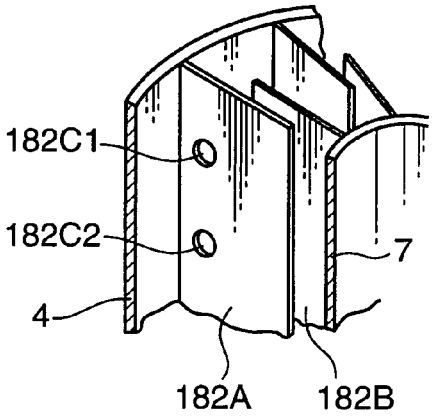
FIG. 18C is an explanatory perspective view showing arrangement of heat transfer fins of the fifth embodiment and the openings formed thereon.
Figure 18D:
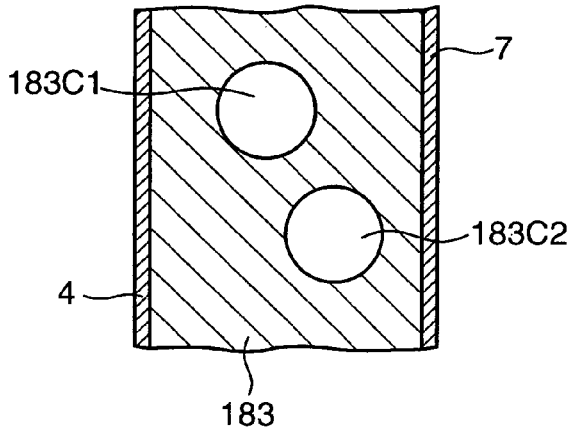
FIG. 18D is a longitudinal sectional view showing a heat transfer fin formed with openings.

Further, the above-described easiness of concrete placement can be similarly improved even in the structure in which the heat transfer fins 180, each is formed with a cutout portion 180C, that is, cut only partially as shown in FIG. 18A, rather than completely, in the axial direction of the container 3 in the separation space like the one 181A shown in FIG. 18B. Needless to say the cutout similar to the one 180C can also be formed on the inner-side end of the heat transfer fin 180. Moreover, if through holes (openings 181C) are provided in addition to the aforesaid separation portion 181A in the heat transfer fins 181 as shown in FIG. 18B, then the concrete can be also caused to flow through those through holes 181C, thereby also increasing the easiness of placing. The shape, number and location of the openings may be appropriately set in balance with the above-described heat transfer capacity. For example, in the case of the zigzag arrangement of heat transfer fins 21, 22 as in the fifth embodiment as shown in FIG. 6, it is preferred that the openings, 182C1, 182C2, be provided in the regions aside of the overlap portions of the both the heat transfer fins 182A, 182B, in order to minimize the decrease in heat transfer capacity. Yet moreover, it may be possible to provide a heat transfer fin 183, as shown in FIG. 18D, having both of radial ends fixed to the outer shell 4 and the inner shell 7, respectively, and on which it is formed with a plurality of openings 183C1, 183C2 (not limited to the plural opening configuration but a single opening can be used). As described for the embodiments shown in FIGS. 18A, 18B, and 18C, the shape, number and location of the openings may be appropriately set in balance with the above-mentioned heat transfer capacity. Furthermore, any feasible combination of the openings shown in FIGS. 18A to 18D, can be made without departing the essential concept of the present invention.

Figure 17A:
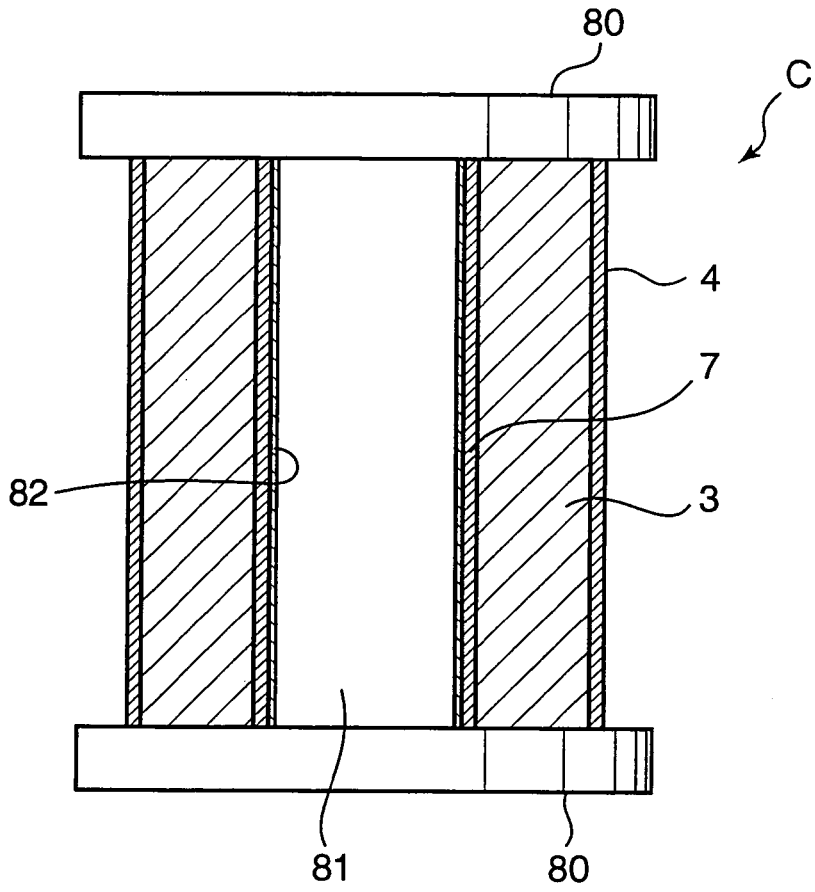
FIG. 17A is a longitudinal sectional view of a sample in a heat transfer capacity verification test of concrete cask of the fifth embodiment.
Figure 17B:
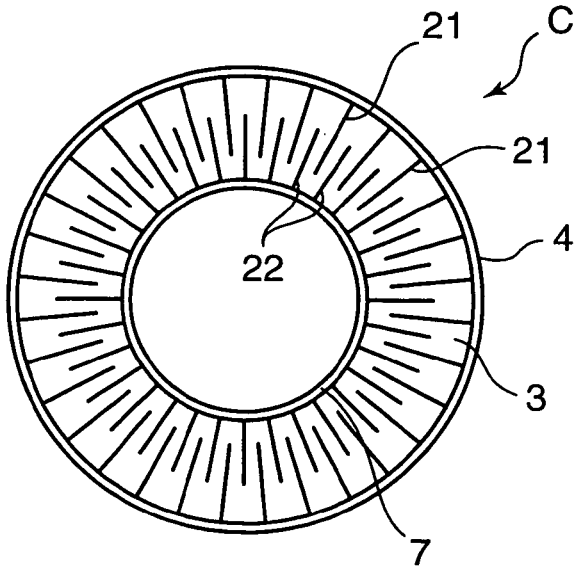
FIG. 17B is a lateral sectional view.

The verification test of heat transfer performance of the concrete cask will be described below. FIG. 17A is a longitudinal sectional view of a sample in the heat transfer capacity verification test of the concrete cask of the fifth embodiment. FIG. 17B is a lateral sectional view.

A heat transfer sample C used in the verification test is shown in FIG. 17. The heat transfer sample C is equivalent to the structure in which a tubular portion of the container body 1 of the concrete cask of the fifth embodiment is cut out and comprises the aforesaid inner and outer shells 7, 4 and the concrete shielding body 3. As shown in FIG. 17A, both end surfaces in the axial direction of the heat transfer sample C are covered with thermally insulating materials 80, 80.

A thermally insulating material 81 is also disposed inside the inner shell 7. A cylindrical gap of an appropriate thickness if formed between the thermally insulating material 81 and the inner shell 7, and a heater 82 for heating is disposed in this gap portion. The thermally insulating material 81 and heater 82 are not shown in FIG. 17B.

In the structure shown in FIG. 17, a heat transfer test was carried out with a heater output of 2.1 kW. The heat transfer analysis was also conducted under the identical conditions and the analysis results were compared with the results of the heat transfer test. Here, (w) was 90 mm and (a) was 38 mm.

The mixing composition of the concrete material used for the heat transfer test is shown in Table 1. The materials used for the sample are shown in Table 2.

TABLE 1 mixing composition of the concrete material used for the heat transfer test

| Unit Amount (Kg/m$^3$) | | | | | | | |
|---|---|---|---|---|---|---|---|
| | | | | | Chemical Admixture | | |
| low heat | | | Metal | | high performance | | |
| Portland cement | silica fume | calcium hydroxide | iron powder | iron fiber | AE water reducing agent | deforming agent | water |
| 287 | 32 | 1131 | 640 | 157 | 94 | 0.9 | 281 |

TABLE 2

Materials Used for the Test

| Parts Name | Material | Thickness (mm) | Heat Conductivity (W/m · K) |
|---|---|---|---|
| Inner shell | carbon steel | 16 | 52 |
| Outer shell | carbon steel | 16 | 52 |
| Heat Trans Fin | cupper | 2 | 398 |
| Shielding body | concrete | 250 | 2.0 |

Calculating (λf×t)/Lc and (λc×w)/a from those dimensions and physical property values, yields the following:

$$(\lambda f \times t)/Lc = 3.1(W/m \cdot K)$$

$$(\lambda c \times w)/a = 3.3(W/m \cdot K).$$

It is clear, that the aforesaid formula [T], that is, $$(\lambda f \times t)/Lc \leqq (\lambda c \times w)/a,$$

is satisfied.

The results of the heat transfer test and heat transfer analysis are shown in Table 3.

TABLE 3 results of the heat transfer test and heat transfer analysis (Unit: degree in Celsius)

| | Temp of Inner shell | Temp of Outer shell |
|---|---|---|
| Test results | 88 | 68 |
| Result by Heat Transfer Analysis | 88 | 67 |

The results matched well and the difference in temperature between the inner shell and outer shell was about 20° C. in both the heat transfer test and the heat transfer analysis. On the other hand, the difference in temperature between the inner shell and outer shell that was calculated for the conventional structure in which the inner and outer shells were connected by heat transfer fins by using the present test model was about 20° C. and was confirmed to be equal to that of the heat transfer test results and heat analysis results obtained for the concrete cask of the present invention. The above results proved that the concrete cask in accordance with the present invention has sufficient heat transfer capacity (heat removal capacity).

Eight embodiments of the present invention are described above, but the present invention is not limited to the configurations of the above-described embodiments, and a variety of modifications can be made without departing from the essence of the present invention. For example, in the first embodiment, the explanation was conducted with respect to a concrete cask for accommodating a radioactive substance contained in a canister in an accommodation unit. However, the present invention is also applicable to a concrete cask accommodating a radioactive substance contained in a basket.

Furthermore, in the above-described embodiments, the heat transfer fins (11, etc.) were installed radially along the axial direction of the container 3. However, a configuration may be also employed in which the heat transfer fins are formed to have a fan-like shape perpendicular to the axial direction of the container and are mounted with equal spacing in the axial direction, alternately on the inner and outer shells 7, 4, while ensuring the overlap region necessary for thermal conduction (modification example of the aforesaid fifth embodiment).

Further, when a structure is used with the heat transfer fins having a fan-like shape, if air bubbles are introduced into the concrete during placing, the problem is that they hang on the heat transfer fins and are difficult to remove. In order to resolve this problem associated with degassing, the heat transfer fins may be inclined so that the edge portions thereof be higher than the mounting position or the heat transfer fins may be inclined spirally.

The present invention has the above-described configuration and therefore produces the following effects.

In summary, the present invention relates to a concrete cask, in which a shielding body composed of concrete and heat transfer fins made from metal are provided between an inner shell and an outer shell made from metal and which comprises an accommodation portion formed inside the inner shell for accommodating a radioactive substance, a containment structure is employed to shield the accommodation portion from the outside of the cask, and said heat transfer fins each has an inner shell-side and an outer shell-side and is configured such that said inner shell-side is in contact with the inner shell and the outer shell-side is formed with at least a portion that is not in contact with the outer shell or such that said outer shell-side is in contact with the outer shell and the inner shell-side is formed with at least a portion that is not in contact with the inner shell. Therefore, in the conventional structure in which the heat transfer fins were connected to both the inner shell and the outer shell, it was necessary to place the concrete in each cell individually, whereas in accordance with the present invention such a configuration is not necessary and the manufacture is facilitated.

Furthermore, in the conventional structure, because the heat transfer fins could create a region in which the shielding body was not present over the entire range in the radial direction, there was a problem associated with radiation streaming. However, in accordance with the present invention, even if the radiation passes through the heat transfer fins, it also has to pass through the shielding body before it can reach the outer shell. Therefore, the radiation streaming can be suppressed.

In the above described cask, the concrete cask may comprise at least first heat transfer fins provided in contact with the outer shell-side and second heat transfer fins provided in contact with the inner shell-side, the first heat transfer fins and second heat transfer fins being provided so as to overlap each other and so that there is a distance between both the heat transfer fins in the overlap portion. The advantage of this configuration is that, in addition to the effect identical to that of claim 1, because the overlap portion is present, thermally conductive properties can be sufficiently ensured by the discontinuous region of heat transfer fins.

Furthermore, if the length of the overlap portion of the both the heat transfer fins is denoted by w1 and the distance between the both the heat transfer fins in the overlap portion is denoted by a1, the following relationship is preferably satisfied: $a\mathbf{1} \leqq (2 \cdot \lambda c \cdot w\mathbf{1} \cdot Lc)/(\lambda f \lambda t)$. Therefore, heat transfer capacity equal to or better than that obtained when the heat transfer fins connect the outer and inner shells, as in the conventional configuration, can be obtained.

Moreover, the side of the heat transfer fins that forms the separation portion can be formed to have an almost L-like shape so as to be provided with an opposite surface facing the inner shell or the outer shell. Therefore, heat transfer to the side opposite to that where the heat transfer fins are mounted can be enhanced. Furthermore, because the heat transfer fins are secured only to one shell of the inner shell and outer shell, the mounting time is shortened.

Furthermore, if the separation distance of the separation portion is denoted by a2, the following relationship is satisfied: $a\mathbf{2} \leqq (2 \cdot \lambda c \cdot w\mathbf{2} \cdot Lc)/(\lambda f \cdot t)$. Therefore, heat transfer capacity equal to or better than that obtained when the heat transfer fins connect the outer and inner shells, as in the conventional configuration, can be obtained.

As an alternate example, the heat transfer fins can be formed to have an almost I-like shape. Therefore, the manufacture of the heat transfer fins is facilitated and the production cost and the number of operations can be reduced.

In one example, the separation portion can be composed so as to separate completely the heat transfer fins and the inner shell or outer shell. Therefore, because the heat transfer fins are mounted only on the outer shell or inner shell, the time required for mounting the heat transfer fins can be saved. Furthermore, because the inner shell and outer shell are not connected, the inner shell and outer shell can be manufactured independently. Therefore, the manufacturing process can be shortened.

In another example, the heat transfer fins are disposed at an angle to the radial direction of the shielding body. Therefore, the radiation streaming can be avoided more reliably.

Furthermore, openings can be formed in the heat transfer fins. Therefore, concrete can easily flow through the opening and concrete placing is facilitated.

In another form of the embodiment of the present invention, a concrete cask comprising a shielding body composed of concrete and provided between the inner shell and the outer shell made from metal and an accommodation portion for accommodating a radioactive substance inside the inner shell, wherein a containment structure is employed to shield the accommodation portion from the outside of the cask, and the shielding body is composed of concrete that has good thermal conductivity comprising a metal material. Therefore, introducing a metal material increases thermal conduction capacity and makes it possible to provide a cut portion between the heat exchange fins and the inner shell or outer shell, thereby suppressing radiation streaming. Furthermore, the concrete density is increased and gamma radiation shielding capacity is increased.

In the aforementioned embodiments, the thermal conductivity of the shielding body is preferably 4 (W/m·K) or more. Therefore sufficient thermal conduction capacity can be obtained. In particular, because a sufficient heat removal capacity can be attained even when no heat transfer fins are present, the heat transfer fins can be omitted and the structure of the concrete cask can be simplified.

In the aforementioned embodiments, the shielding body comprises a metal material in at least one shape of grains, particles, or fibers. Therefore, thermal conduction capacity can be improved.

Moreover, the shielding body preferably contains 15 mass % or more of hydroxide retaining water as crystals with a melting point and decomposition temperature higher than 100° C. Therefore, the shielding body has excellent neutron shielding capacity, in particular in a high-temperature environment with a temperature of 100° C. and higher.

Yet moreover, the hydroxide shows poor solubility or insolubility in water. Therefore, the hydroxide that neither decomposes nor releases water at a temperature of 100° C. and higher can be reliably introduced into the cured body obtained after hydration with the cement.

Furthermore, the shielding body is preferably sealed so as to be shielded from outside air. Therefore, the concrete material is prevented from reacting with carbon dioxide present in the atmosphere and releasing hydrogen present therein and the degradation of neutron shielding capacity can be prevented.

The invention also related to a method for manufacturing the concrete cask, the method comprises a mixing step for mixing a shielding body material that forms the shielding body and a placing step for placing the mixed shielding body materials, wherein the shielding body material is vacuum degassed in at least one of those processes. Therefore, pores present in the concrete shielding body can be eliminated and a concrete cask with excellent shielding capacity can be obtained.

In the mixing step, the shielding body material is vacuum degassed by mixing the shielding body material in a mixing chamber of a mixing machine and degassing the inside of the mixing chamber with a vacuum pump. Therefore, the introduction of air during mixing is prevented. As a result, pores present in the concrete shielding body can be eliminated and a concrete cask with excellent shielding capacity can be obtained.

In the placing step, the shielding body material is vacuum degassed by placing the shielding body material mixed in the mixing step into a space formed between the inner shell and the outer shell and degassing the space with a vacuum pump. Therefore, the introduction of air during placing is prevented. As a result, pores present in the concrete shielding body can be eliminated and a concrete cask with excellent shielding capacity can be obtained.

This application is based on Japanese patent application serial no. 2003-24208, filed in Japan Patent Office on Jan. 31, 2003, the contents of which are hereby incorporated by reference.

Although the present invention has been fully described by way of example with reference to the accompanying drawings, it is to be understood that various changes and modifications will be apparent to those skilled in the art. Therefore, unless otherwise such changes and modifications depart from the scope of the present invention hereinafter defined, they should be construed as being included therein.

What is claimed is:

1. A concrete cask comprising:

an inner shell made from metal;

an outer shell made from metal;

a shielding body composed of concrete and provided between said inner shell and said outer shell;

heat transfer fins provided between said inner shell and said outer shell; and an accommodation portion formed inside said inner shell for accommodating a radioactive substance therein thereby being kept from the outside of the cask, wherein said concrete includes portland cement, and said heat transfer fins each has an inner shell-side and an outer shell-side and is configured such that said inner shell-side is in contact with the inner shell and the outer shell-side is formed with at least a portion that is not in contact with the outer shell; or such that said outer shell-side is in contact with the outer shell and the inner shell-side is formed with at least a portion that is not in contact with the inner shell.

2. The concrete cask according to claim 1, comprising at least a first heat transfer fin provided in contact with said outer shell and a second heat transfer fin provided in contact with said inner shell, the first heat transfer fin and the second heat transfer fin being provided so as to overlap each other and so that there is a clearance between said first and said second heat transfer fins in said overlap portion.

3. The concrete cask according to claim 2, wherein when the length of the overlap portion of said first and said second heat transfer fins is denoted by w1 and the clearance between said first and said second heat transfer fins in the overlap portion is denoted by a1, then the following relation is satisfied:

$$a1\cdot(2\cdot\lambda c\cdot w1\cdot Lc)/(\lambda f\cdot t),$$

where $\lambda c$: thermal conductivity of the concrete (W/m·K);

Lc: thickness of the concrete shielding body (m);

$\lambda f$: thermal conductivity of the heat transfer fins (W/m·K);

t: thickness of the heat transfer fins (m).

4. The concrete cask according to claim 1, wherein the side of said heat transfer fins that forms said separation portion is formed to have substantially an L-like shape so as to be provided with an opposite surface facing said inner shell or said outer shell.

5. The concrete cask according to claim 4, wherein if the separation clearance of said separation portion is denoted by a2, the following relationship is satisfied:

$$a2\cdot(2\cdot\lambda c\cdot w2\cdot Lc)/(\lambda f\cdot t),$$

where $\lambda c$: thermal conductivity of the concrete (W/m·K);

Lc: thickness of the concrete shielding body (m);

$\lambda f$: thermal conductivity of the heat transfer fins (W/m·K);

t: thickness of the heat transfer fins (m);

w2: length of said opposite surface in the width direction (m).

6. The concrete cask according to claim 1, wherein said heat transfer fins are formed to have substantially an I-like shape, when viewed from the shell end.

7. The concrete cask according to claim 1, wherein said separation portion is composed so as to separate completely the heat transfer fins and the inner shell or outer shell.

8. The concrete cask according to claim 1, wherein said heat transfer fins are disposed at an angle to the radial direction of said shielding body.

9. The concrete cask according to claim 1, wherein openings are formed in said heat transfer fins.

10. The concrete cask according to claim 1, wherein said shielding body comprises a metal material in at least one shape of grains, particles, or fibers.

11. The concrete cask according to claim 1, wherein said shielding body contains 15 mass % or more of hydroxide retaining water as crystals with a melting point and decomposition temperature higher than 100° C.

12. The concrete cask according to claim 1, wherein said shielding body is sealed so as to be shielded from outside air.

13. The concrete cask according to claim 1, wherein said radioactive substance is contained in a canister which includes a body and a lid, and said canister is placed in said accommodation portion.

14. A concrete cask comprising:

an inner shell made from metal;

an outer shell made from metal;

a shielding body composed of concrete and provided between said inner shell and said outer shell; and an accommodation portion for accommodating a radioactive substance inside said inner shell thereby being kept from the outside of the cask, wherein said shielding body is composed of said concrete including portland cement and a metal material that has a high thermal conductivity, wherein said cask has heat fins located between said inner shell and said outer shell.

15. The concrete cask according to claim 14, wherein the thermal conductivity of the shielding body is 4 (W/m·K) or more.

16. The concrete cask according to claim 14, wherein said shielding body comprises a metal material in at least one shape of grains, particles, or fibers.

17. The concrete cask according to claim 14, wherein said shielding body contains 15 mass % or more of hydroxide retaining water as crystals with a melting point and decomposition temperature higher than 100° C.

18. The concrete cask according to claim 17, wherein said hydroxide shows poor solubility or insolubility in water.

19. The concrete cask according to claim 14, wherein said radioactive substance is contained in a canister which includes a body and a lid, and said canister is placed in said accommodation portion.

* * * * *